US006871695B2

(12) United States Patent
Sato et al.

(10) Patent No.: US 6,871,695 B2
(45) Date of Patent: Mar. 29, 2005

(54) AIR CONDITIONER HAVING UNIT CONNECTION STRUCTURE

(75) Inventors: Yasuhiro Sato, Okazaki (JP); Mitsutoshi Kato, Toyota (JP); Kazuo Kito, Nagoya (JP); Takuya Natsume, Kariya (JP)

(73) Assignee: Denso Corporation, Kariya (JP)

( * ) Notice: Subject to any disclaimer, the term of this patent is extended or adjusted under 35 U.S.C. 154(b) by 67 days.

(21) Appl. No.: 09/865,182

(22) Filed: May 24, 2001

(65) Prior Publication Data

US 2001/0045268 A1 Nov. 29, 2001

(30) Foreign Application Priority Data

May 25, 2000 (JP) ..... 2000-154919

(51) Int. Cl.[7] ..... B60H 3/00
(52) U.S. Cl. ..... 165/42; 165/76; 165/78
(58) Field of Search ..... 165/42, 43, 76, 165/78, 67, 53, 47; 454/119; 312/198, 236, 271, 275, 292; 62/262

(56) References Cited

U.S. PATENT DOCUMENTS

| | | | | | |
|---|---|---|---|---|---|
| 2,115,587 | A | * | 4/1938 | Anderson | 165/78 |
| 3,882,690 | A | * | 5/1975 | Duell et al. | 165/76 X |
| 4,082,142 | A | * | 4/1978 | Blackburn et al. | 165/76 |
| 4,465,124 | A | * | 8/1984 | Jacquet et al. | 165/78 X |
| 4,465,125 | A | * | 8/1984 | Haas | 165/76 |
| 4,482,011 | A | * | 11/1984 | Jacquet | 165/78 X |
| 4,672,819 | A | * | 6/1987 | Mino et al. | 165/76 X |
| 5,199,277 | A | * | 4/1993 | Granstrom et al. | 165/78 X |
| 5,613,550 | A | * | 3/1997 | Ashida et al. | 165/76 X |
| 5,657,817 | A | * | 8/1997 | Heine et al. | 165/67 |
| 5,660,228 | A | * | 8/1997 | Steege et al. | 165/76 |
| 5,819,841 | A | | 10/1998 | Moynat | 165/78 |
| 5,954,578 | A | * | 9/1999 | Takasaki | 165/42 X |
| 6,032,478 | A | * | 3/2000 | Da Luz Moreas | 62/262 |
| 6,097,599 | A | * | 8/2000 | Jocham et al. | 165/78 X |
| 6,146,210 | A | * | 11/2000 | Cha et al. | |
| 6,422,301 | B1 | * | 7/2002 | Scoccia et al. | 165/42 |

FOREIGN PATENT DOCUMENTS

| | | | | |
|---|---|---|---|---|
| DE | 38 09 627 | | 10/1989 | |
| EP | 0 380 454 A1 | * | 8/1990 | 165/42 |
| GB | 2137816 | | 10/1984 | |
| JP | 53-121341 | * | 10/1978 | 165/76 |
| JP | 62-73021 | * | 4/1987 | 165/76 |
| JP | 3-204531 | * | 9/1991 | |
| JP | 4-143530 | * | 5/1992 | 165/76 |
| JP | 4-148125 | * | 5/1992 | 165/76 |
| JP | 4-155125 | * | 5/1992 | 165/76 |
| JP | 5-187657 | * | 7/1993 | 165/76 |
| JP | 6-221617 | * | 8/1994 | |
| JP | 9-196407 | * | 7/1997 | |
| JP | 9-207545 | * | 8/1997 | |
| JP | 9-240254 | * | 9/1997 | |
| JP | 10-185244 | * | 7/1998 | |
| JP | 10-220809 | * | 8/1998 | |
| JP | 2000-6640 | * | 1/2000 | |
| JP | 2000-16057 | * | 1/2000 | |
| JP | 2001-270318 | * | 10/2001 | |
| JP | 2001-310617 | * | 11/2001 | |

* cited by examiner

*Primary Examiner*—Ljiljana Ciric
(74) *Attorney, Agent, or Firm*—Harness, Dickey & Pierce, PLC

(57) ABSTRACT

In an air conditioner with an inside/outside air unit and an air conditioning unit, an attachment stay having an elongated hole is provided in the inside/outside air unit, and a pin is provided in the air conditioning unit to be fitted into the elongated hole of the attachment stay so that an attachment position between both units are determined. A hook portion is provided in the pin at a top end to form a recess portion between the hook portion and a wall surface of the air conditioning unit, and a plate portion of the attachment stay, defining the elongated hole, is disposed to be engaged with the recess portion after the pin is inserted into the elongated hole.

19 Claims, 3 Drawing Sheets

AIR CONDITIONER HAVING UNIT CONNECTION STRUCTURE

CROSS-REFERENCE TO RELATED APPLICATION

This application is related to Japanese Patent Application No. 2000-154919 filed on May 25, 2000, the contents of which are hereby incorporated by reference.

BACKGROUND OF THE INVENTION

1. Field of the Invention

The present invention relates to a unit connection structure of an air conditioner constructed by plural units. The unit connection structure is suitably applied to a vehicle air conditioner, for example.

2. Description of Related Art

A conventional vehicle air conditioner is constructed by an inside/outside air unit for introducing inside air or outside air and for blowing the introduced air, and an air conditioning unit for adjusting temperature of air blown into a passenger compartment. In this vehicle air conditioner, plural pins and plural holes of both the units are fitted to each other, and both the units are mechanically connected using plural screws.

The air conditioning unit is generally disposed within a dashboard at a center side in a vehicle width direction, and the inside/outside air unit is disposed within the dashboard at a front passenger's side to form a lower foot space for the front passenger. Further, the positions for fastening both the units are restricted so that both the units are not affected by screws or the like. Accordingly, a lower part of the inside/outside air unit is not supported, and a downward moment is applied around the connection portion by the weight of the inside/outside air unit. Therefore, at an upper side position of the connection portion, a case of the inside/outside air unit is readily deformed, and contact surfaces of both units at the connection portion may be separated. Thus, air may be escaped from the connection portion, or an attachment dimension accuracy of both the units on a vehicle may be decreased.

SUMMARY OF THE INVENTION

In view of the foregoing problems, it is an object of the present invention to provide an air conditioner with a connection structure of both units, which prevents a deformation of a case after the both units are connected.

According to the present invention, in air conditioner constructed by connecting an inside/outside air unit and an air conditioning unit, both the inside/outside air unit and the air conditioning unit are fastened using a fastening member after plural pins provided in at least one of both the units are fitted into holes of attachment portions provided in the other one of both the units, respectively. In this air conditioner, at least one of the pins has an engagement portion that is engaged with the corresponding attachment portion in a direction crossing to an insertion direction of the pin into the hole. Thus, in a temporarily attachment state of both the units before being fastened by the fastening member, both the unit can be accurately fixed, and a case deformation due to the weight of both the units can be prevented.

Preferably, the engagement portion is a hook portion protruding to in a direction crossing with the insertion direction of the pin into the hole, and is provided at a top end side of the pin in the insertion direction. On the other hand, the attachment portion has a plate portion defining the hole, the plate portion has a flat surface and a predetermined thickness, the hole is provided in the plate portion to penetrate through the plate portion, and the hook portion is engaged with the plate portion of the attachment portion. Therefore, after the pin is fitted into the hole and the hook portion is engaged with the plate portion, it can prevent both connecting surfaces of both the units at the connection portion from being separated from each other.

Preferably, the pin is provided to protrude to the insertion direction from a wall surface of the one of the inside/outside air unit and the air conditioning unit, the hook portion is provided to form a recess between the hook portion and the wall surface, and the plate portion of the attachment portion is disposed to be engaged with the recess after the pin is inserted into the hole. Accordingly, a deformation of a case member can be further accurately prevented after both the units are connected.

BRIEF DESCRIPTION OF THE DRAWINGS

Additional objects and advantages of the present invention will be more readily apparent from the following detailed description of a preferred embodiment when taken together with the accompanying drawings, in which.

DETAILED DESCRIPTION OF THE PRESENTLY PREFERRED EMBODIMENT

A preferred embodiment of the present invention will be described hereinafter with reference to the accompanying drawings. In this embodiment, an air conditioner 100 of the present invention is typically applied for a vehicle. The air conditioner 100 is constructed by an inside/outside air unit 200 and an air conditioning unit 300, and is disposed in a passenger compartment at a front side of a dashboard.

Figure 2B:
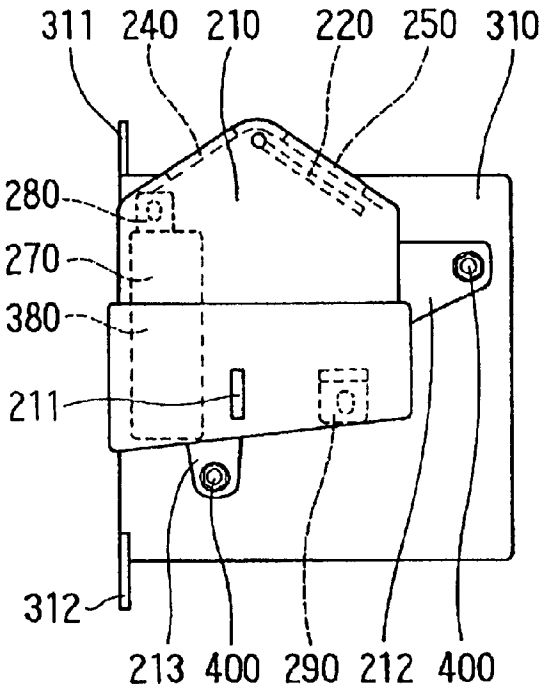
FIGS. 2A and 2B are a front view and a side view, respectively, showing the air conditioner according to the embodiment.
Figure 2A:
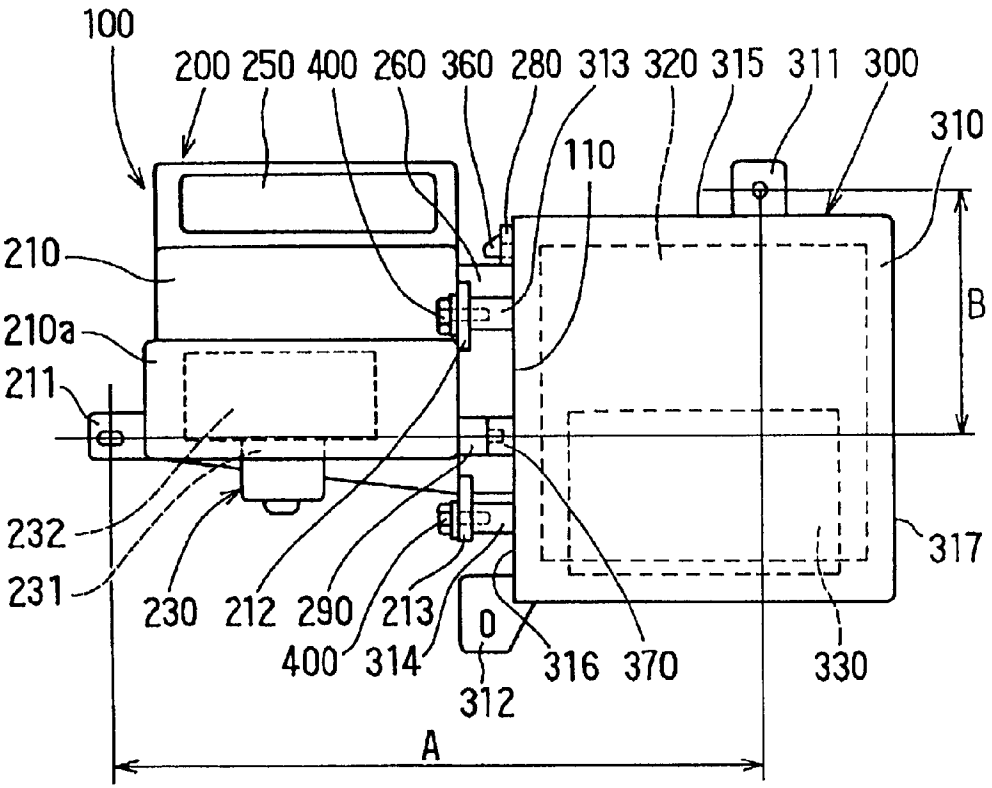

The inside/outside air unit 200 includes a first case 210 for defining an air passage, an inside/outside air switching door 220 and a blower 230. The first case 210 is formed by a polypropylene thin plate, and has an outside air suction port 240 from which outside air outside the passenger compartment is introduced and an inside air suction port 250 from which inside air inside the passenger compartment is introduced. The inside/outside air switching door 220 is operatively linked with an air outlet mode switching unit of the passenger compartment to open and close the outside air suction port 240 and the inside air suction port 250. Outside air or inside air introduced selectively into the first case 210 is blown by the blower 230. As shown in FIG. 2A, the blower 230 has a fan 232 for blowing air and a motor 231 for driving the fan 232. An electrical voltage applied to the motor 231 of the blower 230 is controlled through a blower controller by an electronic control unit (not shown). Air blown by the fan 232 flows into a blower case 210*a* formed into a scroll shape, and is blown into the air conditioning unit 300 from an air blowing port 270 of an air blowing duct 260.

The first case 210 is integrally formed with an attachment stay 211 used for attaching the first case 211 to the vehicle, and attachment stays 212, 213 used for attaching the first case 210 to the air conditioning unit 300. An elongated hole (elliptical hole) is provided in a top end portion of the attachment stay 211, and round holes are provided at top end portions of the attachment stays 212, 213, respectively. In addition, an attachment stay 280 used as a position determination relative to the air conditioning unit 300 and a stay 290 having a pin 290*a* are also integrally formed with the first case 210. The attachment positions of the attachment stay 280 and the stay 290 are set to be diagonal positions relative to the attachment positions of the attachment stays 212, 213.

The air conditioning unit 300 includes an evaporator 320 for cooling air and a heater 330 for heating air which are accommodated within a second case 310 formed by a polypropylene thin plate. An inlet port 380 is provided in the second case 310 to communicate with the air blowing port 270 of the first case 210. Air blown into the second case 310 from the inlet port 380 is cooled while passing through the evaporator 320, and at least a part of air from the evaporator 320 is heated in the heater 330. In the second case 310, an air mixing door is disposed to adjust a ratio of an air amount passing through the heater 330 and an air amount bypassing the heater 330, so that temperature of air blown into the passenger compartment is adjusted.

Figure 1:
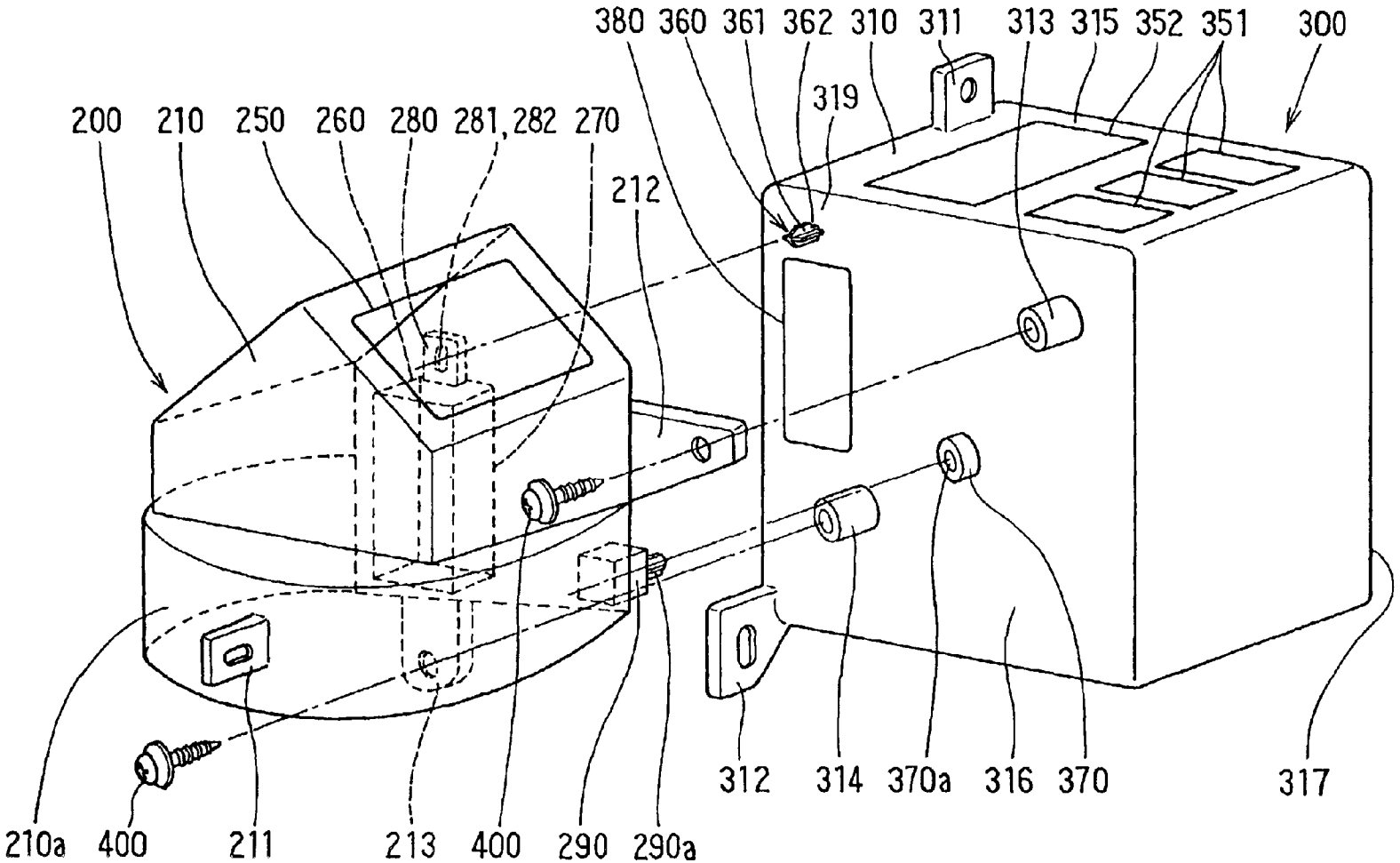
FIG. 1 is a disassembled perspective view showing an entire structure of an air conditioner, according to a preferred embodiment of the present invention.

The second case 310 has a face air outlet 351 from which air is blown toward an upper side of the passenger compartment, a defroster air outlet 352 from which air is blown toward an inner surface of a windshield, and a foot air outlet (not shown) from which air is blown toward a lower side of the passenger compartment. The face air outlet 351, the defroster air outlet 352 and the foot air outlet are provided at a downstream air side on the second case 310, and are opened and closed by plural mode switching doors. As shown in FIG. 1, the face air outlet 351 and the defroster air outlet 352 are provided in an upper surface 315 of the second case 310, and the foot air outlet is provided in left and right side surfaces 316, 317 of the second case 310.

Attachment stays 311, 312 having a round hole and an elongated hole (elliptical hole), respectively, are provided in the second case 310, so that the second case 310 is attached to the vehicle using the attachment stays 311, 312. Further, boss potions 313, 314 (protrusions) are provided in the side surface 316 of the second case 310 to face the holes of the attachment stays 212, 213 of the first case 210, respectively. Specifically, the boss portion 313 has a hole with an inner diameter corresponding to a screw outer diameter of a screw 400, and the boss portion 314 has a hole with an inner diameter corresponding to a screw outer diameter of an another screw 400. In addition, an attachment pin 360 is formed integrally with the second case 310 at a position facing the attachment stay 280, and a boss portion 370 having a hole 370*a* is also integrally formed with the second case 310 at a position facing the pin 290*a* of the attachment stay 290. The attachment pin 360 and the boss portion 370 are used for determining the attachment position with the first case 210.

After the attachment pin 360 is fitted into the elongated hole 281 of the attachment stay 280 and the pin 290*a* of the attachment stay 290 is fitted into the hole 370*a* of the boss portion 370, the attachment stays 212, 213 and the boss portions 313, 314 are fastened using the screws 400, so that the inside/outside air unit 200 and the air conditioning unit 300 are connected to form the air conditioner 100.

After the connection of both the units 200, 300, the air conditioner 100 is mounted on the vehicle to be mechanically fastened by bolts and the like using the attachment stays 211, 311, 312.

Figure 3A:
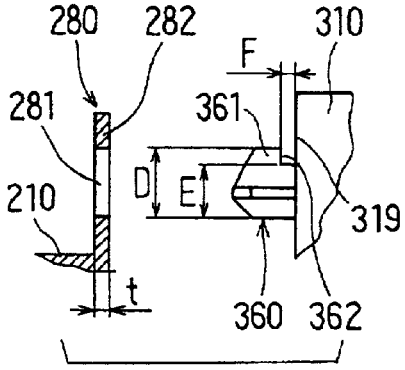
FIG. 3A is a side view showing detail shapes of an elongated hole and a pin.

Next, a connection structure between the attachment stay 280 of the first case 210 and the attachment pin 360 of the second case 310, which is a main part of this embodiment, will be now described with reference to FIGS. 3A, 3B and 3C. The attachment stay 280 is formed from a plate member, and the elongated hole 281 is provided to penetrate through the attachment stay 280. The elongated hole 181 is elongated in a vertical direction to have a major diameter D and a minor diameter E corresponding to a most outer dimension of the attachment pin 360. The attachment stay has a plate portion having a plate thickness "t" and defining the elongated hole 281.

On the other hand, the attachment pin 360 of the second case 310 has a hook portion 361 protruding to a direction crossing with an insertion direction (plate thickness direction) of the elongated hole 281. That is, the hook portion 361 is provided at an upper side of a top end portion of the attachment pin 360 to protrude to a side crossing the insertion direction of the elongated hole 281. The hook portion 361 protrudes from a base wall portion 319 of the attachment pin 360, and a recess portion 362 is formed between the hook portion 361 and the base wall portion 319. Here, the base wall portion 319 constructing the base of the attachment portion 360 is a wall surface of the second case 310. The recess portion 362 has a dimension F in a longitudinal direction of the attachment pin 360, and the dimension F is approximately equal to the plate thickness "t" of the plate portion 282, so that the plate portion 282 is engaged with the recess portion 362 after the pin 360 is inserted and fitted into the hole 281. The attachment pin 360 is formed into a cross shape in cross-section, so that the wall thickness of the attachment pin 360 can be reduced. Further, the top end portion of the attachment pin 360 is inclined to be tapered off so that the attachment pin 360 can be readily inserted into the elongated hole 281 of the attachment stay 280.

Figure 3B:
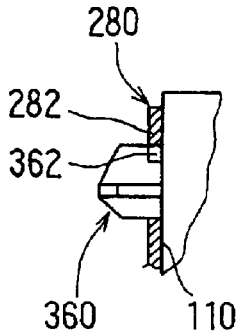
FIG. 3B is a side view showing an insertion state of the pin into the elongated hole.
Figure 3C:
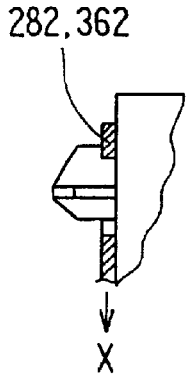
FIG. 3C is a side view showing an engagement state of both the elongated hole and the pin, according to the embodiment.

When the attachment stay 280 and the attachment pin 360 are assembled, the attachment pin 360 is inserted into the elongated hole 281 and penetrate through the elongated hole 281 horizontally until a wall surface of plate portion 282 contacts a connection surface 110 (corresponding to the base wall portion 319) of the second case 310, as shown in FIG. 3B. Thereafter, as shown in FIG. 3C, the plate portion 282 of the attachment stay 280 moves in a lower side indicated by the arrow X in FIG. 3C in the vertical direction due to the weight of the inside/outside air unit to be engaged with the recess portion 362 of the attachment pin 360. Accordingly, the plate portion 282 and the recess portion 362 are engaged with each other opposite to the insertion direction of the attachment pin 362 into the elongated hole 281, so that both the inside/outside air unit 200 and the air conditioning unit 300 are fixed to each other.

According to this embodiment, it can prevent a deformation of the first case 210 due to the wight of the inside/outside air unit 200, and is can prevent the surface of the plate portion 282 from being separated from the contact surface 110. Accordingly, the air conditioner 100 of this embodiment prevents air from being escaped from a connection portion between both the inside/outside air unit 200 and the air conditioning unit 300, and attachment accuracy of the attachment stays 211, 311 attached to the vehicle can be improved. That is, in the air conditioner 100, dimensions indicated by A, B in FIG. 2A can be maintained.

According to the embodiment, after the attachment pin 360 is fitted into the elongated hole 281, the plate portion 282 and the recess portion 362 are engaged with each other by the weight of the inside/outside air unit 200, assembling operation of both the units 200, 300 can be made simple.

In addition, by the engagement of the plate portion 282 and the recess portion 362, both the units 200, 300 can be tightly temporarily fixed. Therefore, in a temporarily fixing state of both the units 200, 300, screw operation using the screws 400 and the like is unnecessary, and detachment performance of both the units 200, 300 can be improved. Because the hook portion 361 is provided at the upper side of the attachment pin 360 in the vertical direction, fastening members such as the screws 400 can be readily attached to the units 200, 300 without using a supporting member.

Although the present invention has been fully described in connection with the preferred embodiment thereof with reference to the accompanying drawings, it is to be noted that various changes and modifications will become apparent to those skilled in the art.

Figure 4:
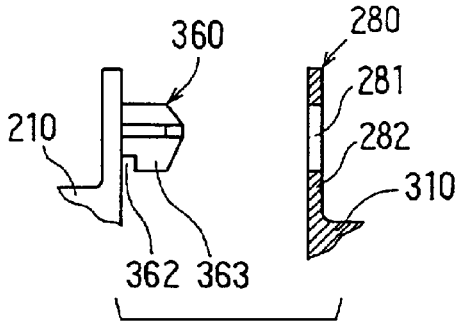
FIG. 4 is a side view showing detail shapes of an elongated hole and a pin, according to a modification of the embodiment.

For example, in the above-described embodiment, the attachment stay 280 having the elongated hole 281 is provided in the first case 210 of the inside/outside air unit 200, and the attachment pin 360 is provided in the second case 310 of the air conditioning unit 300. However, as shown in FIG. 4, the attachment pin 360 can be provided in the first case 210 of the inside/outside air unit 200, and the attachment stay 280 having the elongated hole 281 can be provided in the second case 310 of the air conditioning unit 300. In this case, a hook portion 363 is provided at a lower side of the attachment pin 360 to form the recess portion 362 at the lower side of the attachment pin 360. Because the attachment pin 360 is provided in the first case 210 of the inside/outside air unit 200 having the weight lighter than that of the air conditioning unit 300, the assembling operation of both the units 200, 300 can be readily performed. Further, after the hook portion 363 of the attachment pin 360 is engaged with the elongated hole 281, the attachment pin 360 is difficult to be removed, and therefore, the fastening operation after the engagement operation of both the units 200, 300 can be readily performed.

Figure 5:
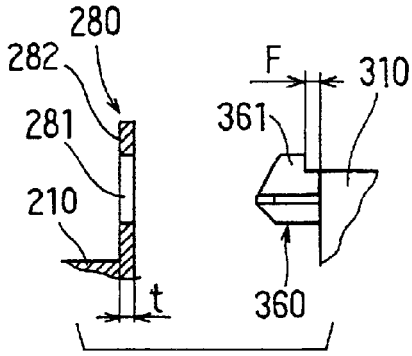
FIG. 5 is a side view showing detail shapes of an elongated hole and a pin, according to an another modification of the embodiment.

Further, as shown in FIG. 5, the attachment pin 360 can be provided at an upper end position of the second case 310. In this case, the recess portion 362 described in the above embodiment is not provided between the hook portion 361 and the base wall portion 319 of the second case 310. Even in this case, the hook portion 361 can be engaged with the plate portion 282 of the attachment stay 280, and the attachment pin 360 is not moved in a direction opposite to the fitting direction of the attachment pin 360 after the attachment pin 360 is fitted into the elongated hole 281. Accordingly, after both the units 200, 300 are connected, a deformation of the first case 210 can be prevented.

The hook portion 361 can be also provided in the pin 290*a* of the stay 290 similarly to the above-described embodiment. In this case, both the units 200, 300 can be further tightly fixed to each other. Further, the inserting direction of the attachment pin 361 and the engagement direction between the plate portion 382 and the recess portion 362 can be suitably changed in accordance with an assembling direction of both units 200, 300.

In the above-described embodiment, the present invention is typically applied to the vehicle air conditioner. However, the connection structure of the present invention may be applied to the other device having a connection of both units.

Such changes and modifications are to be understood as being within the scope of the present invention as defined by the appended claims.

What is claimed is:

1. An air conditioner for a compartment, comprising:

a first unit used for conditioning air provided to the compartment;

a second unit used for conditioning air provided to the compartment;

a pin provided on one of the first and second units;

an attachment stay which has a hole, the attachment stay being provided in the other one of the first and second units at a position corresponding to the pin; and a fastening member for attaching the first and second units together after the pins are fitted into the hole of the attachment stay, wherein the pin has an engagement portion that is engaged with the attachment stay in a direction perpendicular to the insertion direction of the pin into the hole;

the engagement portion is a hook portion protruding in the direction perpendicular to the insertion direction of the pin into the hole, and is provided at a top end of the pin in the insertion direction; and the pin has a cross shape in a cross-section perpendicular to the insertion direction of the pin into the hole.

2. The air conditioner according to claim 1, wherein:

the attachment stay has a plate portion defining the hole, the plate portion having a flat surface and a predetermined thickness;

the hole is provided in the plate portion to penetrate through the plate portion; and the hook portion is engaged with the plate portion of the attachment stay.

3. The air conditioner according to claim 1, wherein the hook portion is at an upper side of the pin in a vertical direction.

4. The air conditioner according to claim 1, wherein:

the pin is provided to protrude in the insertion direction from a wall surface of the one of the first and second units;

the hook portion is provided to form a recess between the hook portion and the wall surface; and a plate portion of the attachment stay is disposed to be engaged with the recess after the pin is inserted into the hole.

5. The air conditioner according to claim 4, wherein:

the pin is disposed to be inserted into the hole horizontally; and the plate portion of the attachment stay and the recess are engaged in the vertical direction.

6. The air conditioner according to claim 4, wherein the predetermined thickness of the plate portion is equal to or less than a width of the recess in the insertion direction.

7. The air conditioner according to claim 1, wherein the hole is an elongated hole.

8. An air conditioner for a compartment, the air conditioner comprising:

a first unit used for conditioning air provided to the compartment;

a second unit used for conditioning air provided to the compartment;

a pin provided on one of the first and second units, the pin extending from a surface of the one of the first and second units in an axial direction generally perpendicular to the surface of the one of the first and second units;

an attachment stay defining a hole having a depth in the axial direction, the attachment stay being provided in the other one of the first and second units;

an engagement portion defined by the pin at a position adjacent the surface of the one of the first and second units, the attachment stay engaging the engagement portion in a direction generally perpendicular to the axial direction when the attachment stay is disposed adjacent the surface of the one of the first and second units; wherein the pin has a cross shape in a cross-section perpendicular to the axial direction.

9. The air conditioner according to claim 8, wherein the engagement portion is a hook portion protruding in the direction generally perpendicular to the axial direction.

10. The air conditioner according to claim 9, wherein the attachment stay includes a plate portion defining the hole, the hook portion is engaged with the plate portion of the attachment stay.

11. The air conditioner according to claim 9, wherein the hook portion is at an upper side of the pin in a vertical direction.

12. The air conditioner according to claim 9, wherein the hook portion is at a lower side of the pin in a vertical direction.

13. The air conditioner according to claim 9, wherein:

the hook portion defines a recess between the hook portion and the surface of the one of the first and second units; and the attachment stay includes a plate portion defining the hole, the plate portion being disposed within the recess.

14. An air conditioner for a compartment, the air conditioner comprising:

a first unit used for conditioning air provided to the compartment;

a second unit used for conditioning air provided to the compartment;

a first pin provided on one of the first and second units, the first pin extending from a surface of the one of the first and second units in an axial direction generally perpendicular to the surface of the one of the first and second units;

a first attachment stay defining a hole having a depth in the axial direction, the first hole defined in the first attachment stay being provided in the other one of the first and second units;

an engagement portion defined by the first pin at a position adjacent the surface of the one of the first and second units, the first attachment stay engaging the engagement portion in a direction generally perpendicular to the axial direction when the first attachment stay is disposed adjacent the surface of the one of the first and second units;

a second pin provided on the first unit, the second pin extending from a surface of the first units in a direction generally parallel to the axial direction; wherein:

the second unit defines a second hole, the second pin being disposed within the second hole, engagement between the second pin and the second hole permitting movement of the first unit with respect to the second unit in a direction generally parallel with the axial direction but prohibiting translational movement of the first unit with respect to the second unit in a direction generally perpendicular to the axial direction.

15. The air conditioner according to claim 14, wherein the engagement portion is a hook portion protruding in the direction generally perpendicular to the axial direction.

16. The air conditioner according to claim 15, wherein the first attachment stay includes a plate portion defining the hole, the hook portion is engaged with the plate portion of the first attachment stay.

17. The air conditioner according to claim 15, wherein the hook portion is at an upper side of the first pin in a vertical direction.

18. The air conditioner according to claim 15, wherein the hook portion is at an lower side of the first pin in a vertical direction.

19. The air conditioner according to claim 15, wherein:

the hook portion defines a recess between the hook portion and the surface of the one of the first and second units; and the first attachment stay includes a plate portion defining the first hole, the plate portion being disposed within the recess.

* * * * *

UNITED STATES PATENT AND TRADEMARK OFFICE

CERTIFICATE OF CORRECTION

PATENT NO. : 6,871,695 B2
APPLICATION NO. : 09/865182
DATED : March 29, 2005
INVENTOR(S) : Yasuhiro Sato et al.

It is certified that error appears in the above-identified patent and that said Letters Patent is hereby corrected as shown below:

Column 6, line 9:
Add: Claim __ . The air conditioner according to Claim 1, wherein:

the first unit is an inside/outside air unit disposed for introducing air therein and for blowing the introduced air; and the second unit is an air temperature adjusting unit for cooling and heating air blown from the inside/outside air unit, the air temperature adjusting unit being disposed to adjust temperature of air to be blown into the compartment.

Signed and Sealed this

Fourteenth Day of November, 2006

JON W. DUDAS
*Director of the United States Patent and Trademark Office*